United States Patent [19]

Damiano et al.

[11] Patent Number: 4,564,256

[45] Date of Patent: Jan. 14, 1986

[54] FLAT CABLE TRANSITION CONNECTOR

[75] Inventors: Ralph R. Damiano, Naugatuck; Wilfred R. Rogers, Bristol; Charles A. Whitney, Canton, all of Conn.

[73] Assignee: The Wiremold Company, West Hartford, Conn.

[21] Appl. No.: 534,203

[22] Filed: Sep. 21, 1983

[51] Int. Cl.[4] ..... H01R 4/24

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,444,506 | 5/1969 | Wedekind | 339/99 R |
| 3,840,840 | 10/1974 | Worth | 339/99 R |
| 3,879,099 | 4/1975 | Shaffer | 339/99 R |
| 4,099,822 | 7/1978 | Carlisle et al. | 339/98 |
| 4,193,201 | 3/1980 | Van Horn | 339/98 |
| 4,352,537 | 10/1982 | Guelden | 339/97 P |

FOREIGN PATENT DOCUMENTS

| | | | |
|---|---|---|---|
| 2254395 | 5/1974 | Fed. Rep. of Germany | 339/99 R |

*Primary Examiner*—Joseph H. McGlynn

*Attorney, Agent, or Firm*—Hayes & Reinsmith

[57] ABSTRACT

An electrical transition connector is disclosed for establishing an electrical transition connection between a multiple conductor flat cable and plurality of individual wire conductors. The conductor includes a pair of mating housing blocks with one of the blocks having multiple pairs of circular openings centered on opposite sides of a blade contact slot. The other housing block has blade contact slots formed therein and matching the blade contacts slots of said one housing block for alignment in registration with one another when the housing blocks are assembled. A blade contact is received in each matching pair of blade contact slots. A pair of jacking screws extend through the one housing block and threadably engage the second housing block for securing the blocks in assembly, whereby each blade contact is secured in an operative position for establishing an electrical transition connection between a flat cable conductor and an individual wire conductor.

15 Claims, 10 Drawing Figures

FLAT CABLE TRANSITION CONNECTOR

FIELD OF THE INVENTION

This invention generally relates to electrical connectors and particularly concerns electrical transition connectors for establishing an electrical connection between a multiple conductor flat cable and a plurality of individual wire conductors.

BACKGROUND OF THE INVENTION

The electrical connector of this invention provides a variety of power and communications outlet combinations for use with high flexibility undercarpet wiring for branch circuit power distribution in open areas and, specifically, establishes an electrical transition connection from a plurality of individual wire conductors to a multiple conductor flat cable at a feed point in the system as well as a transition conversion from a multiple conductor flat cable to a plurality of individual wire conductors at a conventional pedestal having one or more receptacles for providing power and/or communications outlets.

U.S. Pat. No. 3,197,729 to Sarazen shows an electrical connector for interconnecting a flat and round conductor, the connector comprising a flat conductive material having a plurality of lances extending outwardly from a flat surface to pierce a flat conductor and thereby make an electrical connection. A tubular section is adjacent the flat surface for making a connection with the round wire. U.S. Pat. No. 3,995,104 to Wasserman is illustrative of a connector for making an electrical connection with flat adhesive tape containing a wire running longitudinally through the connector. The connector is flat and contains a plurality of prongs which are pushed through the tape and thereafter crimped over the wire in the tape.

Other teachings showing self piercing electrical connectors for making an electrical connection with a flat conductor are illustrated in the United States patents to Rickards No. 4,018,499 and Kuo No. 3,728,473.

However, the known prior art does not provide a solution for undercarpet cable systems exhibiting facile conversion between multiple conductor flat wire cable and wire conductors for quick and easy installation, for example, of duplex power, data and telephone cables.

SUMMARY OF THE INVENTION

It accordingly is an object of this invention to provide an electrical transition connector comprising two housing blocks that provide the requisite electrical connection between flat cable conductors and individual wire conductors. Each wire conductor is inserted into an interior of an upper housing block through a pair of openings formed therethrough and is placed in a wire conductor slot of an insulation piercing blade contact located in a contact slot in the upper housing block. The flat conductor is then placed between the housing blocks, and the blade contact is driven through the flat conductor and into a matching contact slot formed in the lower housing block. The housing blocks are fastened together by jacking screws located outboard of the flat cable to clamp the housing blocks together and complete the electrical connection between the flat cable and wire conductors upon each conductor of the flat cable being pierced by its respective blade contact and extruded against opposite faces of the blade contact received in its respective slot in the lower housing block.

Other objects will be in part obvious and in part pointed out in more detail hereinafter.

A better understanding of the objects, advantages, features, properties and relations of the invention will be obtained from the following detailed description and accompanying drawings which set forth an illustrative embodiment and are indicative of the ways in which the principle of the invention is employed.

DESCRIPTION OF A PREFERRED EMBODIMENT

Figure 1:
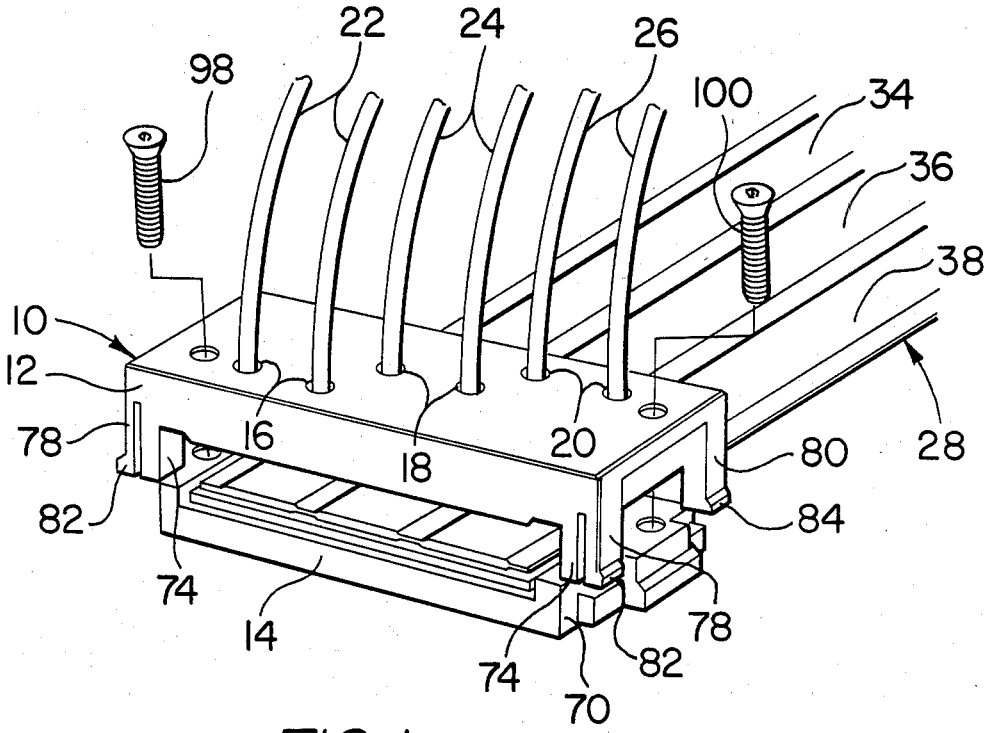
FIG. 1 is an exploded isometric view of housing blocks of an electrical transition connector of this invention in association with individual wire conductors and a multiple conductor flat cable prior to the housing blocks being completely assembled.
Figure 7:
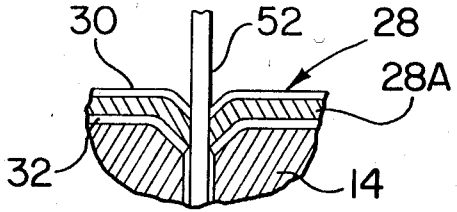
FIG. 7 is an enlarged fragmentary view of a portion of the contact area between the contact and flat cable conductor illustrated in FIG. 6.

Referring now to the drawings in detail, an electrical transition connector 10 is illustrated in FIG. 1 comprising first and second mating housing blocks, namely, an upper block 12 and a lower block 14 both of which are generally rectilinear in configuration with the upper housing block 12 having multiple pairs of wire conductor receiving apertures. These apertures are illustrated in the form of three pairs of circular openings 16, 18 and 20 which extend through upper block 12 for receiving three transition connector pigtails which comprise the plurality of individual wire conductors. These conductors are illustrated at 22, 24 and 26 and will be understood to have insulative jackets to different colors which in turn may be matched with corresponding colors marked on a multiple conductor flat cable 28 which will be understood to have an electrically insulative casing formed of opposed plastic sheets 30, 32 (FIG. 7) which envelope flat spaced apart electrical conductors which may be longitudinal runs of copper, e.g., (as seen in FIG. 7) and are marked by color coding strips 34, 36, 38 on the plastic casing sheets 30, 32 corresponding to the colors of the transition pigtails 22, 24, 26 respectively.

Figure 3:
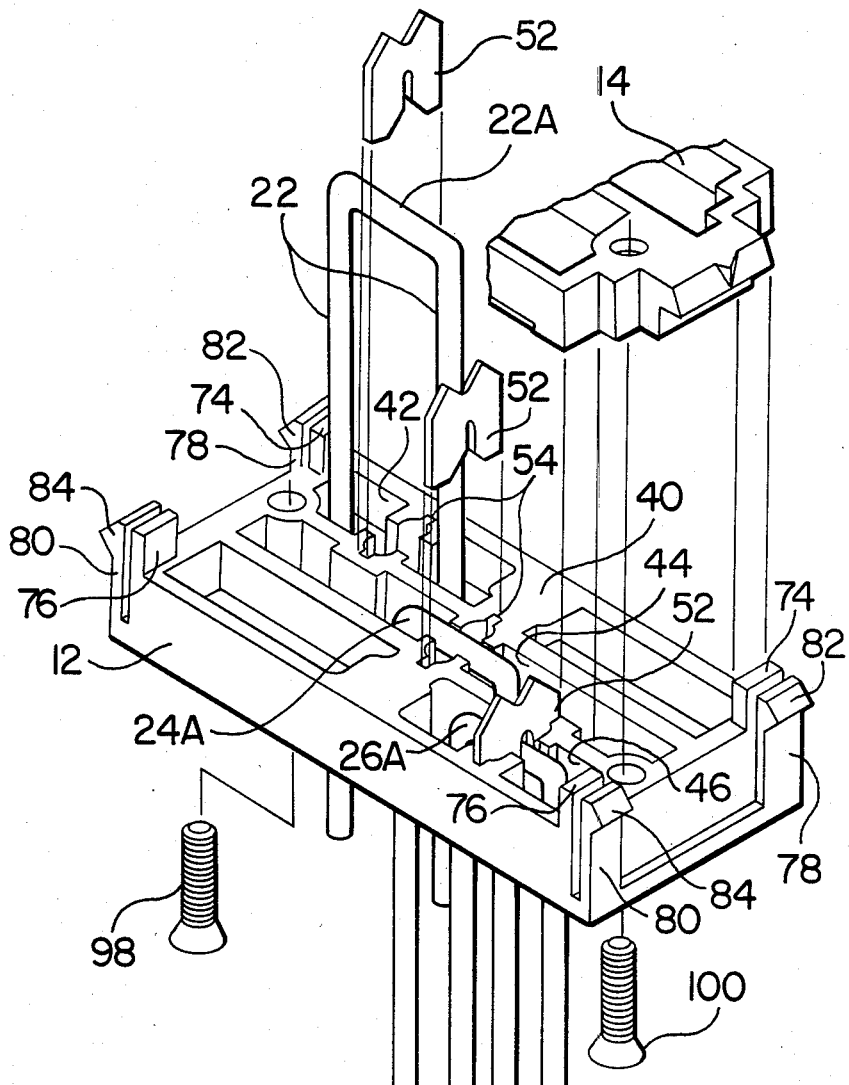
FIG. 3 is an exploded isometric view, partly broken away, showing certain key components of the electrical connector of FIG. 1 with the housing blocks upside-down relative to their normal operative position.

For clarity, upper block 12 is shown inverted in FIG. 3 with its interior face 40 confronting lower block 14. In the specifically illustrated embodiment, the three color coded individual wire conductors 22, 24, 26 are trained through their respective pair of circular openings in upper block 12 whereby bights, such as at 22A, 24A, 26A, in FIG. 3, are received within recessed portions 42, 44, 46 on the interior face 40 of upper block 12 with the pigtails of the wire conductors each being disposed externally of block 12. Desirably, the individual wire conductors 22, 24, 26 are preassembled in block 12 with each wire conductor being pierced and engaged by opposed insulation severing arms 48, 50 of an electrically conductive blade contact 52 (FIG. 5) received in a slot 54 formed internally within upper block 12.

For securing each of the blade contacts 52 in precisely aligned registration with the individual wire conductors, a matching slot 54A is formed (FIG. 4) in a flat interior surface 56 of lower block 14 to extend partially through block 14. Each pair of matching slots 54 and 54A correspond to each pair of wire conductor receiving openings 16, 18, 20. More specifically, each pair of wire conductor receiving openings 16, 18, 20 is centered on opposite sides of its corresponding blade contact slot 54 in upper block 12 and serves to not only secure its respective wire conductor but additionally effects strain relief for that wire conductor to prevent any strain being transmitted to the electrical connection to be established within connector 10.

Figure 4:
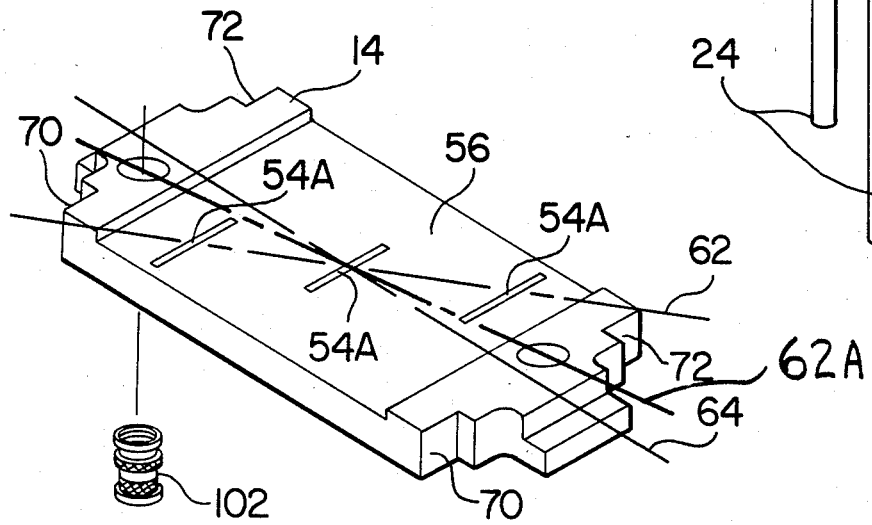
FIG. 4 is an isometric view showing an interior face of the lower housing block of the electrical connector of FIG. 1.
Figure 5:
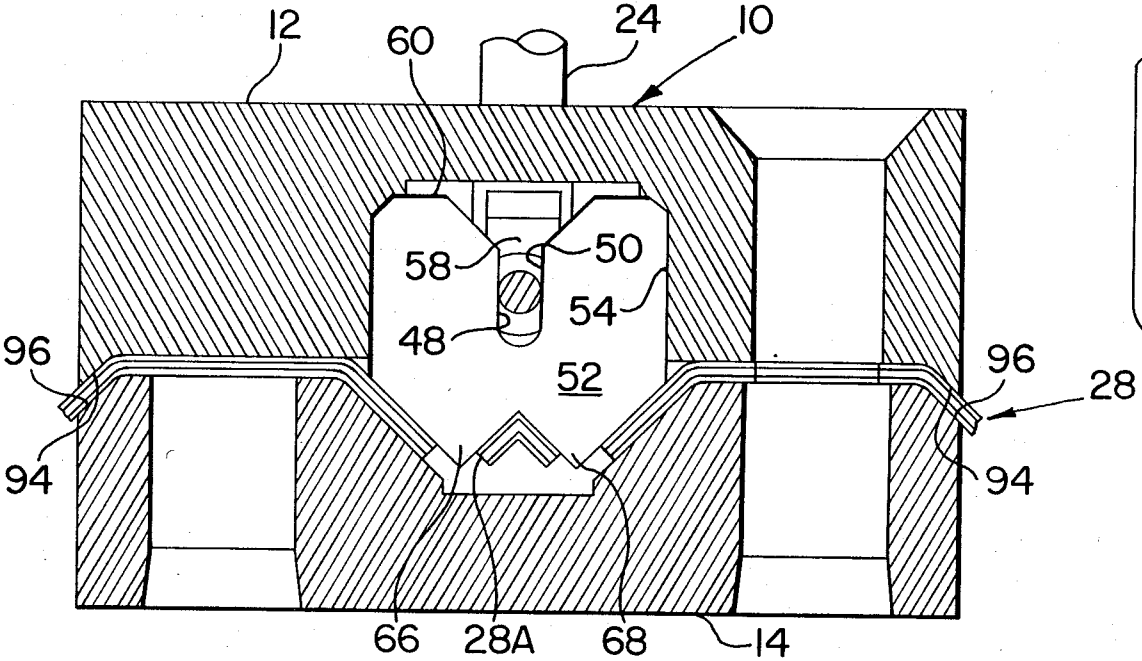
FIG. 5 is an enlarged section view, partly broken away, illustrating an electrical connection established by a contact of the electrical connector of FIG. 1 with a conductor of a flat cable and an individual wire conductor.

As best seen in FIG. 5, each blade contact 52 (only one shown in FIG. 5) has a wire conductor slot 58 extending downwardly from its upper edge 60 between the confronting insulation severing arms 48, 50. These blade contacts 52 are respectively received within the contact slots 54 of upper block 12 and are aligned to register with the matching contact slots 54A exposed in flat surface 56 (FIG. 4) of lower block 14 when the housing blocks are in assembled relation.

To provide an electrical connection between each blade contact 52 and a conductor of the multiple conductor flat cable 28 with the blade contact 52 being generally aligned with a center line of its respective flat cable conductor, and at the same time to minimize the size of the electrical transition connector 10, each pair of wire conductor openings 16, 18, 20 is formed in upper block 12 in parallel alignment with the other pairs of openings. The matching contact slots 54, 54A are likewise formed in their respective housing blocks 12, 14 in parallel alignment with the wire conductor openings 16, 18, 20 and, upon assembly, are located along an axis 62 (FIG. 4) skewed relative to coincident major axes of the housing blocks 12,14 (such as that axis 64 shown in FIG. 4) extending between opposite longitudinal ends of those housing blocks. Such construction provides for each blade contact 52 to be aligned with a longitudinal center line extending along a run of its respective flat cable conductor, thereby to additionally maximize the integrity of the electrical connections between the blade contacts 52 and conductors of flat cable 28.

More specifically, the multiple conductor flat cable 28 of the illustrated embodiment has three runs of flat conductor which upon assembly are disposed on the interior flat surface 56 of lower block 14 with the center line of each flat conductor being generally aligned with its blade contact slot 54A.

Figure 6:
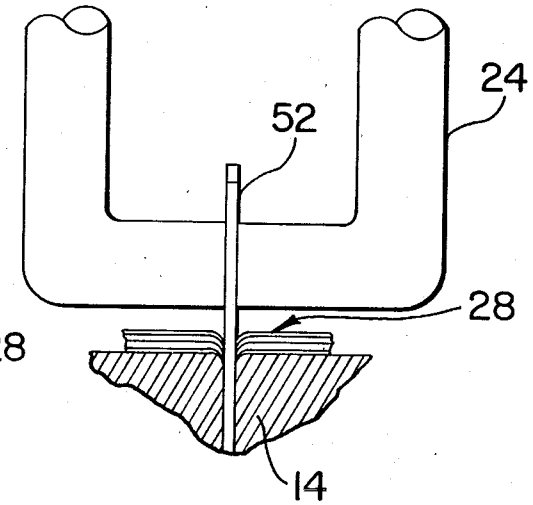
FIG. 6 is an enlarged side view, partly in section and partly broken away, of the electrical connection illustrated in FIG. 5 with the upper housing block being deleted for purposes of clarity.

To minimize the penetration force required for each blade contact 52 to pierce its respective flat cable conductor, such as at 28A in FIGS. 5 and 7, and at the same time provide an overall low profile for the electrical transition connector assembly, each blade contact 52 is formed with a pair of adjacent flat cable conductor piercing teeth 66, 68 with cutting edges of each tooth forming an angle of about 90°, each pair of teeth being in symmetry with the wire conductor slot 58 of its respective blade contact 52. As best seen in FIG. 5, two penetrating cutting wedges are accordingly formed with the cutting edges being at 45° angles respectively relative to a longitudinal axis extending along the wire conductor slot 58 of its respective blade contact 52, thereby minimizing resistance to blade contact penetration of its respective flat cable conductor 28A while additionally providing for extrusion (FIGS. 6 and 7) of the flat cable conductor contact area against full faces of opposite sides of each blade contact 52 for an electrical connection of high integrity.

In the specifically illustrated embodiment, precision alignment of upper and lower housing blocks 12 and 14 is preferably achieved by providing guide shoulders 70, 72 respectively defined by a pair of cut-out portions (FIGS. 3 and 4) formed on block 14 at each corner of its opposite longitudinal ends. Upper housing block 12 is formed with an integral projection 74, 76 adjacent each corner of that block 12 for engagement with guide shoulders 70, 72 to effect precision alignment and registration during assembly.

Figure 9:
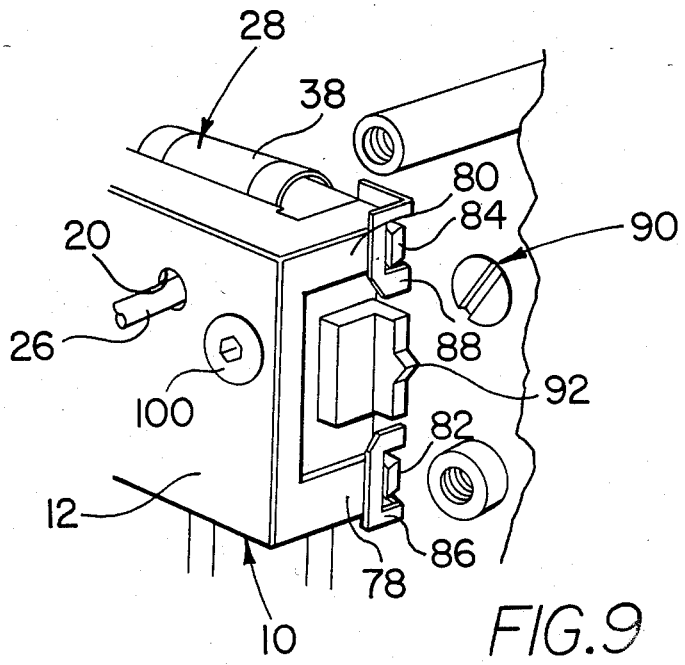
FIG. 9 is an enlarged fragmentary isometric view, partly broken away, showing a snap mounting arrangement employed in the installation of the electrical transition connector of FIG. 8.

Adjacent each corner projection 74, 76 of upper block 12, a resilient finger 78, 80 is formed to project in generally parallel alignment to its resepective projection 74, 76, and a mounting box snap-locking tab 82, 84 is formed on each finger 78, 80. By virture of such construction, tabs 82, 84 of transition connector 10 may be snapped into lugs 86, 88 on a feedbox base 90 (FIG. 9) for quick and easy installation of the electrical transition connector 10. If it is desired to mount the connector 10 on a floor mounted pedestal, e.g., (not shown), central guide projections may be formed, as best seen in FIG. 9, to protrude outwardly from each of the opposite longitudinal ends of one of housing blocks such as the assembly guide projection 92 shown formed on lower block 14 with the projections 92 being located on a major longitudinal axis of that block. Such construction permits the projections 92 to align and guide pedestal mounting over the transition connector 10 with the pedestal being precisely centered over the flat conductor cable 28, thereby to prevent any pedestal hold-down mounting screws from penetrating cable 28.

Figure 2:
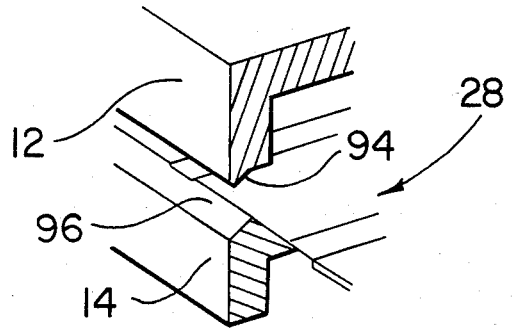
FIG. 2 is an enlarged fragmentary section view, partly broken away, showing mating longitudinal edges of housing blocks of the connector of FIG. 1.

During assembly, the multiple conductor flat cable 28 is inserted between housing blocks 12, 14 with the different conductor color strips 34 36, 38 marked on flat cable 28 being understood to be aligned with the transition connector pigtails 22, 24, 26 of like colors with cable 28 centered in connector 10. To provide flat conductor strain relief, longitudinally extending edges of upper block 12 (FIGS. 2 and 5) are formed with protruding angled surfaces 94 in mating relation to longitudinally extending bevelled 96 edges of lower block 14. Accordingly, the longitudinally extending edges 94, 96 of the housing blocks 12, 14 respectively cooperate to provide flat cable strain relief upon assembly. If the transition connector 10 is being assembled on a feed end of the multiple conductor flat cable 28, a squared end of that cable 28 is initially aligned (FIG. 2) with an inner edge of the bevel on one longitudinally extending edge 96 of lower block 14. With flat cable 28 centered in connector 10, some thumb pressure then may be manually applied to initiate penetration of each electrical blade contact 52 into flat cable 28, it being understood that the transition connector pigtails 22, 24, 26 are secured by their respective blade contacts 52 with each wire conductor pigtail being gripped by its blade contact against unintended displacement within the blade contact slot 54 of the upper housing block 12.

Figure 8:
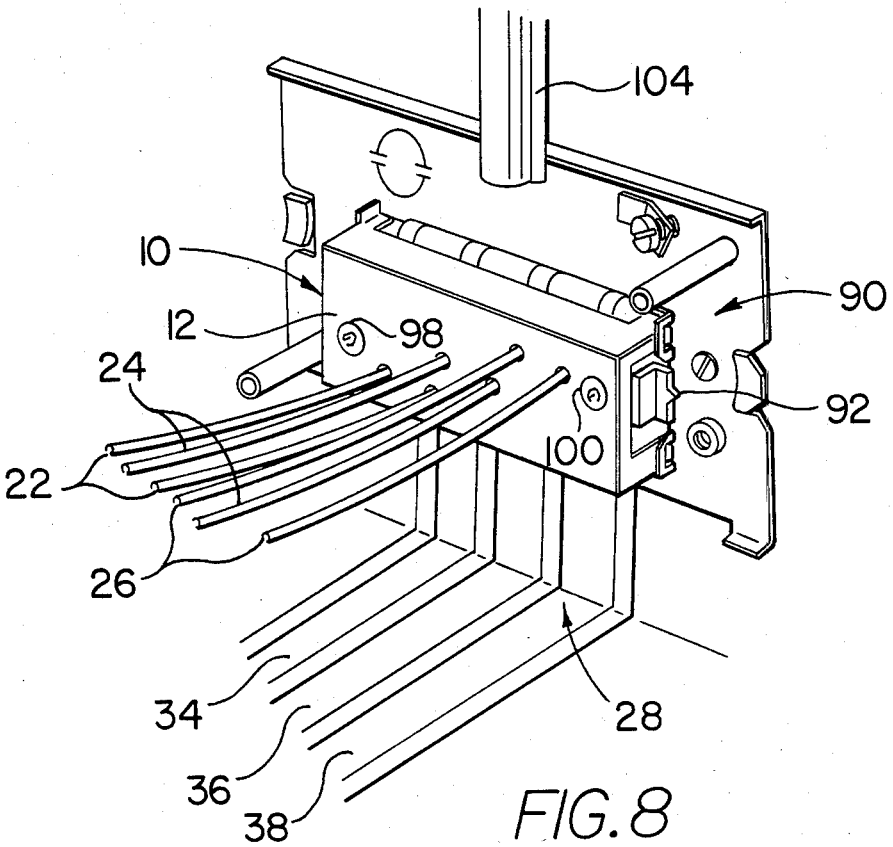
FIG. 8 is an isometric view, partly broken away, showing a typical installation of the electrical transition connector of FIG. 1.

Thereafter, with the flat cable alignment being maintained, upper block 12 may be tightened evenly onto lower block 14 by means of jacking screws 98, 100 which extend through upper block 12 for threaded engagement with bushings, such as the one shown in FIG. 4 at 102, which will be understood to be integrally secured in aligned position in lower block 14. As illustrated in FIGS. 4, 8, and 9, jacking screws 98, 100 are disposed at opposite ends of housing blocks 12, 14 in outwardly laterally offset relation to the flat interior surface 56 of lower block 14, and thereby outboard of the multiple conductor flat cable 28, to prevent any unintended penetration of cable 28 by jacking screws 98, 100. To enable upper block 12 to be positioned on lower block 14 in either of two aligned upper block positions displaced 180° from one another, jacking screws 98, 100 and their respective bushings, such as shown at 102 are formed in blocks 12, 14 along a skewed axis such as shown at 62A in FIG. 4.

As jacking screws 98, 100 are tightened evenly and increased clamping forces are applied to upper and lower blocks 12, 14, each conductor of flat cable 28 is increasingly pierced by teeth 66, 68 of its respective blade contact 52 and extruded as described above against opposite faces of that contact 52 whereby the flat cable conductor such as at 28A is effectively gripped between the lower block surfaces surrounding each blade contact slot 54A and its respective blade contact 52, thereby to further secure each blade contact 52 in proper registration with both its flat cable conductor 28A and its wire conductor. As best seen in FIG. 8, the installation of transition connector 10 on wall surface feedbox 90 is achieved by looping flat cable 28 under transition connector 10 to effect strain relief, and connector 10 is then snapped into lugs such as at 86, 88 on the feedbox base 90 by pressing each of the fingers 78, 80 into operative assembled position. Thereafter, flat cable 28 may be creased at the floor line and cross-taped to the floor near its crease; the entire run then may be continued to complete installation of flat cable 28. Feed wiring, not shown, may be brought into the feedbox from a suitable raceway such as illustrated at 104 in FIG. 8 and connected to the transition pigtails 22, 24, 26 in accordance with conventionally approved techniques.

As will be apparent to persons skilled in the art, various modifications, adaptations and variations of the foregoing specific disclosure can be made without departing from the teachings of this invention.

We claim:

1. For establishing an electrical transition connection between a multiple conductor flat cable and a plurality of individual wire conductors, a connector comprising first and second mating housing blocks, the first housing block having multiple pairs of openings serving as wire conductor receiving apertures, the first and second housing blocks respectively having matching slots corresponding to each pair of openings in the first housing block, the matching slots being aligned in registration with one another when the housing blocks are in assembled relation, a blade contact received in each of the matching slots of the first and second housing blocks, each pair of openings in the first housing block being disposed on opposite sides of its corresponding blade contact slot and serving to secure a wire conductor, and fastening means for clamping the housing blocks in assembled relation, each blade contact being secured in an operative position when the housing blocks are in assembled relation for establishing an electrical transition connection between a flat cable conductor and an individual wire conductor.

2. The connector of claim 1 wherein the fastening means includes a pair of jacking screws extending through the first housing block and threadably engageable with the second housing block, the jacking screws being disposed at opposite ends of the housing blocks in outwardly laterally offset relation to the blade contacts.

3. The connector of claim 1 wherein the housing blocks are generally rectilinear and have opposite longitudinal ends, one of the first and second housing blocks having a cutout portion in each of its opposite longitudinal ends defining a guide shoulder, and wherein the other of the first and second housing blocks includes an integral projection adjacent each of its longitudinal ends, the projections being engageable with the guide shoulders for precision alignment and registration of the housing blocks during assembly.

4. The connector of claim 1 wherein the housing blocks are generally rectilinear and have opposite longitudinal ends, wherein a resilient finger is formed to project from one of the housing blocks adjacent each of its opposite longitudinal ends, and wherein a mounting box snap-locking tab is formed on each of the fingers.

5. The connector of claim 1 wherein the housing blocks are generally rectilinear and have opposite longitudinal ends, and wherein one of the first and second housing members has an assembly guide projection protruding outwardly from each of its opposite longitudinal ends with the projections each being located on a major longitudinal axis of said one housing block.

6. The connector of claim 1 wherein the housing blocks are generally rectilinear, wherein longitudinally extending edges of one of the housing blocks are bevelled, and wherein longitudinally extending edges of the other of the housing blocks have protruding angled surfaces in mating relation to the longitudinally extending bevelled edges of said one housing block, whereby the longitudinally extending edges of the housing blocks cooperate to provide flat cable strain relief upon assembly.

7. The connector of claim 1 wherein a wire conductor slot extends from one edge of each blade contact between two confronting insulation severing arms, and wherein a flat cable conductor piercing tooth projects in a direction opposite said one edge of each blade contact.

8. The connector of claim 7 wherein an individual wire conductor is trained through each pair of apertures of the first housing block with a bight of the wire conductor located inside the connector upon assembly of its housing blocks, and wherein each blade contact serves to establish an electrical connection with an individual wire conductor when the insulation severing arms of each blade contact pierce and engage its respective wire conductor upon assembly, each wire conductor being gripped and secured by its blade contact against unintended displacement.

9. The connector of claim 7 wherein the second housing block has a flat surface which, upon assembly, is in confronting relation to the first housing block, and wherein a multiple conductor flat cable is received, upon assembly, between the housing blocks with that flat cable supported on the flat surface of the second housing block.

10. The connector of claim 9 wherein the fastening means includes a pair of jacking screws extending through the first housing block and threadably engageable with the second housing block, the jacking screws being disposed at opposite ends of the housing blocks in outwardly laterally offset relation to the flat surface of the second housing block and outboard of the multiple conductor flat cable.

11. The connector of claim 1 wherein the housing blocks are each generally rectilinear and, upon assembly, have coincident major axes extending between opposite longitudinal ends of the housing blocks, and wherein each pair of wire conductor receiving openings is formed in the first housing block in parallel alignment with the other pairs of apertures.

12. The connector of claim 11 wherein the matching slots are formed in their respective housing blocks in parallel alignment.

13. The connector of claim 12 wherein the wire conductor receiving apertures and the matching slots are, upon assembly, located along an axis skewed relative to the coincident major axes of the housing blocks.

14. For establishing an electrical transition connection between a multiple conductor flat cable and a plurality of individual wire conductors, a connector comprising first and second mating housing blocks, the first housing block having multiple pairs of wire conductor receiving apertures, the first and second housing blocks respectively having multiple pairs of matching slots corresponding to each pair of wire conductor receiving apertures, the matching slots being aligned in registration with one another when the housing blocks are in assembled relation, a blade contact received in each pair of the matching slots of the first and second housing blocks, each blade contact having a wire conductor slot extending from one edge of each blade contact between two confronting insulation severing arms, each blade contact having a pair of flat cable conductor piercing teeth projecting in a direction opposite said one edge of each blade contact, the pair of teeth being formed in adjacent relation to one another with edges on each tooth merging with one another and forming an angle of about 90°, the teeth of each blade contact being in symmetry with their respective wire conductor slot, and fastening means for clamping the housing blocks in assembled relation, each blade contact being secured in an operative position when the housing blocks are in assembled relation for establishing an electrical transition connection between a flat cable conductor and an individual wire conductor.

15. For establishing an electrical transition connection between a multiple conductor flat cable and a plurality of individual wire conductors, a connector comprising first and second mating housing blocks, the first housing block having multiple pairs of wire conductor receiving apertures, the first and second housing blocks respectively having multiple pairs of matching slots corresponding to each pair of wire conductor receiving apertures, the matching slots being aligned in registration with one another when the housing blocks are in assembled relation, a blade contact received in each pair of the matching slots of the first and second housing blocks, the second housing block having a flat surface which, upon assembly, is in confronting relation to the first housing block, a multiple conductor flat cable received, upon assembly, between the housing blocks with that flat cable supported on the flat surface of the second housing block, and fastening means for clamping the housing blocks in assembled relation, the tooth of each blade contact being registrable with its respective slot in the second housing block, each conductor of the flat cable being pierced by the tooth of its respective blade contact and extruded against opposite faces of the blade contact received in its respective slot in the second housing block upon subsequent clamping force being applied, each blade contact being secured in an operative position when the housing blocks are in assembled relation for establishing an electrical transition connection between a flat cable conductor and an individual wire conductor, the flat cable conductor being effectively gripped between its respective blade contact and the second housing block surfaces surrounding that blade contact thereby to further secure that blade contact in proper registration with both its flat cable conductor and its wire conductor.

* * * * *